US009353571B2

(12) United States Patent
Coe

(10) Patent No.: US 9,353,571 B2
(45) Date of Patent: May 31, 2016

(54) PAINT CAN SECURING APPARATUS FOR USE WITH A LADDER

(71) Applicant: James Coe, Virginia Beach, VA (US)

(72) Inventor: James Coe, Virginia Beach, VA (US)

( * ) Notice: Subject to any disclaimer, the term of this patent is extended or adjusted under 35 U.S.C. 154(b) by 13 days.

(21) Appl. No.: 14/340,104

(22) Filed: Jul. 24, 2014

(65) Prior Publication Data

US 2016/0024845 A1 Jan. 28, 2016

(51) Int. Cl.
*E06C 7/14* (2006.01)
*B65D 5/355* (2006.01)

(52) U.S. Cl.
CPC ..... *E06C 7/14* (2013.01); *B65D 5/0005* (2013.01)

(58) Field of Classification Search
CPC ..... E06C 7/714; B65D 5/0005
USPC ..... 206/737
See application file for complete search history.

(56) References Cited

U.S. PATENT DOCUMENTS 2,911,133 A 11/1959 Ruggieri
3,407,514 A * 10/1968 Alpha ..... G09B 17/00 434/174
4,829,699 A * 5/1989 Perkins ..... A01K 97/06 43/54.1
5,052,581 A * 10/1991 Christ ..... E06C 7/14 15/257.06
5,333,823 A 8/1994 Joseph
5,622,278 A 4/1997 Fries et al.
5,992,617 A * 11/1999 Couch ..... B44D 3/125 206/15.2
6,467,577 B1 10/2002 Charlebois
8,561,954 B2 10/2013 Padilla
2004/0099675 A1* 5/2004 Peck ..... B44D 3/127 220/737

* cited by examiner

*Primary Examiner* — Anthony Stashick
*Assistant Examiner* — James M Van Buskirk
(74) *Attorney, Agent, or Firm* — William G. Sykes

(57) ABSTRACT

A paint can support box adapted to surround and selectively seal a paint can. A hinged top with a seal is affixed to the box and is movable between an open and a closed position. A mounting system attaches the box to rungs of a ladder. A retaining pin prevents the mounting system from inadvertently becoming detached from the ladder rungs. The box is swivelably attached to the mounting system so that the box remains level regardless of the lean angle of the ladder. The box and its contents may be left on the ladder when the ladder is moved to a new location without risk of paint spilling or the apparatus becoming detached from the ladder. Caulk tubes may also be stored and retained within the box. Multiple size paint cans (e.g. gallon, quart, etc.) may be securely accommodated and sealed with appropriate can adapters.

11 Claims, 4 Drawing Sheets

PAINT CAN SECURING APPARATUS FOR USE WITH A LADDER

FIELD OF THE INVENTION

The invention pertains to paint can support devices for use with ladders and, more particularly, to a self-sealing, self-leveling paint can support for attachment to a ladder.

BACKGROUND OF THE INVENTION

When painting out-of-reach surfaces, painters and other tradesmen typically resort to ladders for access to such surfaces. A class of ladders known generically as "stepladders" allows access to lower surfaces. However, to access higher surfaces, a class of ladders known as "extension ladders" must be used.

Stepladders typically have steps that are relatively deep and have flat upper surfaces, typically rectangular in shape. On the other hand, extension ladders typically have round or substantially round rungs in place of steps. Consequently, support structures suitable for use with stepladders for holding a can of paint or similar finishing material are typically unsuitable for use with an extension ladder, and vice versa.

Stepladders are typically shorter and in some ways easier to move when a different region to be painted must be reached. Normally the painter must descend relatively few steps and, if necessary, carrying a can or bucket of paint up and down is relatively easy. When painting from an extension ladder, a painter must typically descend more steps than when painting from a stepladder. Also, the nature of extension ladder rungs versus the deep, flat steps of a stepladder makes the task more difficult. Carrying tools or paint buckets up and down an extension ladder is also more difficult because both of a painter's hands may be required to safely descend the extension ladder.

No ladder attachments are known in the prior art suitable for reliably and conveniently supporting a can of paint on an extension ladder. Most know supports consist of a simple S-hook that surrounds a rung and supports the bail of a paint can. Consequently, when it is necessary to move the extension ladder, the painter must descend carrying the paint can since moving the ladder may cause the paint to spill from the can left suspended on an upper region of the extension ladder.

It would, therefore, be advantageous to provide a support that easily, removably attached to an extension ladder and which supports a can of paint or similar material. The support apparatus should be self-leveling to compensate for different angles at which the extension ladder may be leaning against a structure. Further, the support apparatus should provide a way to seal the paint can's opening when required so that the paint can may be left at the top of the extension ladder while the extension ladder is moved without risk of spilling the paint can's contents.

DISCUSSION OF THE RELATED ART

Several attempts to provide support structures for ladders may be found in the prior art. Most are directed to use with stepladders. For example, U.S. Pat. No. 2,911,133 for STEP-LADDER ATTACHMENT issued Nov. 3, 1959 to Anthony J. Ruggieri provides an improved stepladder attachment for use particularly by painters, carpenters, etc., providing novel means for holding conveniently at hand various tools, supplies and articles which may be needed that may be expeditiously and firmly secured in position on a conventional stepladder without the necessity of making structural alterations to the stepladder.

U.S. Pat. No. 5,333,823 for DETACHABLE DEVICE HOLDING APPARATUS FOR A STEPLADDER issued Aug. 2, 1994 to Thomas J. Joseph discloses an apparatus that removably attaches to the top platform of a stepladder, the apparatus includes a plate mounted to the stepladder, a bucket receptacle disposed on top of the plate, the bucket receptacle being used to hold items such as paint cans, nails or cleaning implements therein. The bucket receptacle is provided with tapered sides and a gasket to securely hold a paint can therewithin. The apparatus also includes one or more side attachments disposed on top of the plate integrally connected with the bucket receptacle. The side attachments are formed with various recesses or tool support shelves for securely holding various implements such as power tools, hand tools, paintbrushes or cleaning implements.

U.S. Pat. No. 5,622,278 for LADDER CADDY issued Apr. 22, 1997 to Randy L. Fries et al. teaches a ladder caddy for a stepladder comprising a container for storing articles therein. A structure is for retaining the container in a removable manner to an upper back portion of the stepladder, so that a person standing on and about the stepladder can retrieve the articles from the container.

U.S. Pat. No. 6,467,577 for LADDER MATE issued Oct. 22, 2002 to Edward A. Charlebois, Jr. discloses an open tool box with a cover positionable over a portion of the box. The cover is adapted to hook onto the top of a stepladder.

U.S. Pat. No. 8,561,964 for COMBINED LADDER ENGAGEABLE TOOL CARRIER AND STEP STOOL issued Oct. 22, 2013 to Richard Padilla provides a tool carrying device configured for removable engagement atop a stepladder and to provide elevated support for a user when the carrying device is positioned on the ground. A secure removable engagement with the top of the ladder is provided by walls descending from a top which form a skirt to surround the top end of the ladder and hold the device from sliding therefrom. Removable tool holders and shelves to hold and store tools are provided, allowing the user a secure tool box when atop a ladder and a slightly elevated working structure for tasks requiring a lower elevation for the user.

None of the patents, taken singly, or in any combination are seen to teach or suggest the paint can securing apparatus for use with a ladder of the present invention.

SUMMARY OF THE INVENTION

In accordance with the present invention there is provided a paint can support system consisting of a box adapted to surround a paint can. A hinged top with an appropriate seal is hingedly affixed to the box and may be selectively closed and latched by latching mechanism 138 to seal the paint can so as to prevent spillage. A mounting system attaches the box to two rungs of a ladder. A retaining pin or other similar device prevents the mounting system from inadvertently becoming detached from the ladder rungs. The box is swivelably attached to the mounting system so that the box remains level regardless of the lean angle of the ladder. The box and its contents may be left on the ladder when the ladder is moved to a new location without risk of paint spilling or the apparatus becoming detached from the ladder. Caulk tubes may also be stored and retained within the box. Multiple size paint cans (e.g. gallon, quart, etc.) may be securely accommodated and sealed by using a can adapter of an appropriate size.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a paint can support system consisting of a box adapted to surround a paint can that may be removably, securely attached to an extension ladder or the like.

Figure 1:
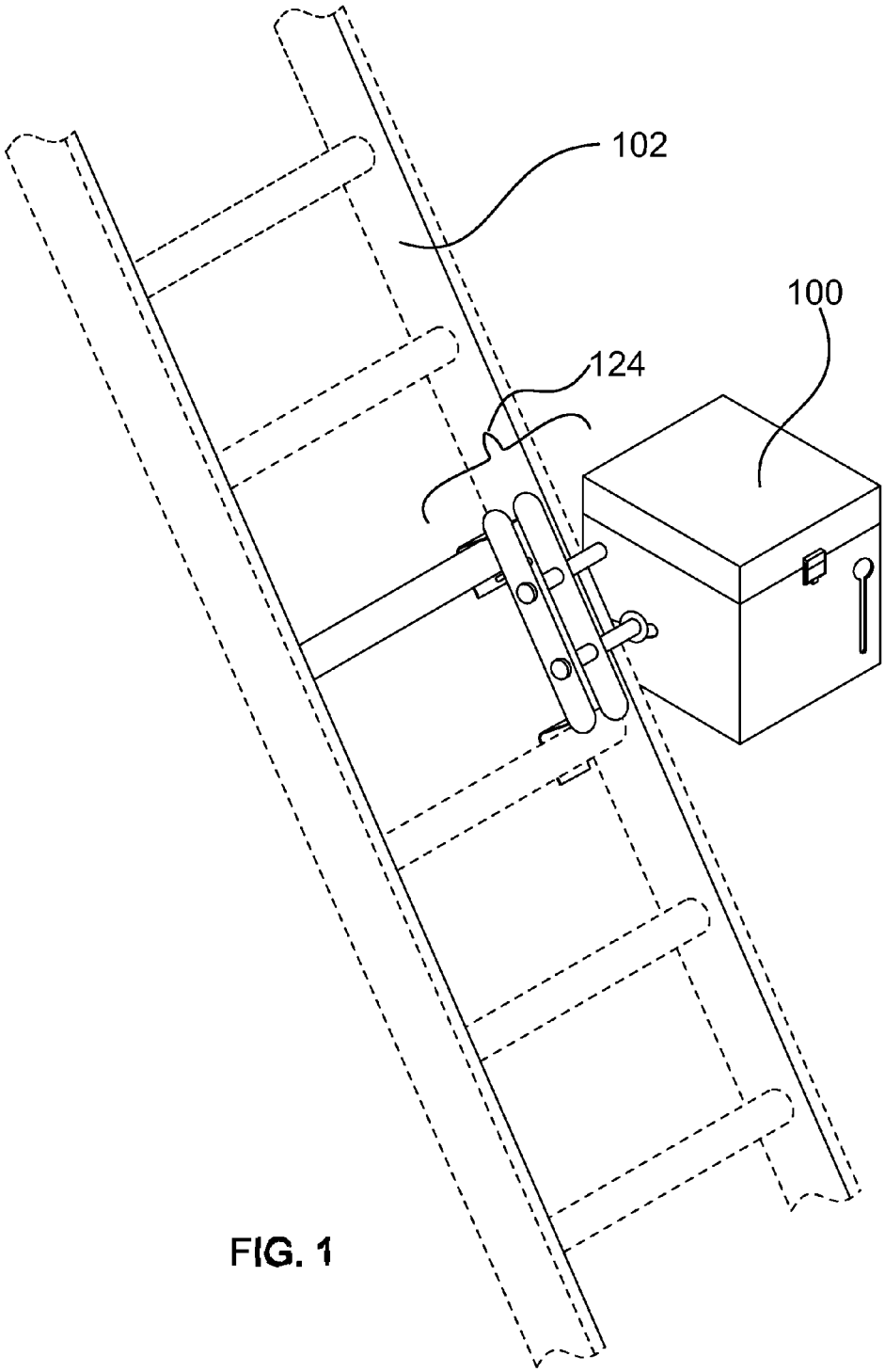
FIG. 1 is a perspective, schematic view of a paint can retaining box with its support system in accordance with the invention shown attached to a ladder.

Referring first to FIG. 1, there is shown a perspective, schematic view of a paint can retaining box with its support system in accordance with the invention, generally at reference number 100. Paint can retaining box 100 is shown attached by an attachment system 124, best seen in FIG. 2, to a ladder 102 by in a typical operating disposition. Ladder 102 forms no part of the present invention and is shown merely to illustrate the intended operating environment for paint can retaining box 100.

Figure 2:
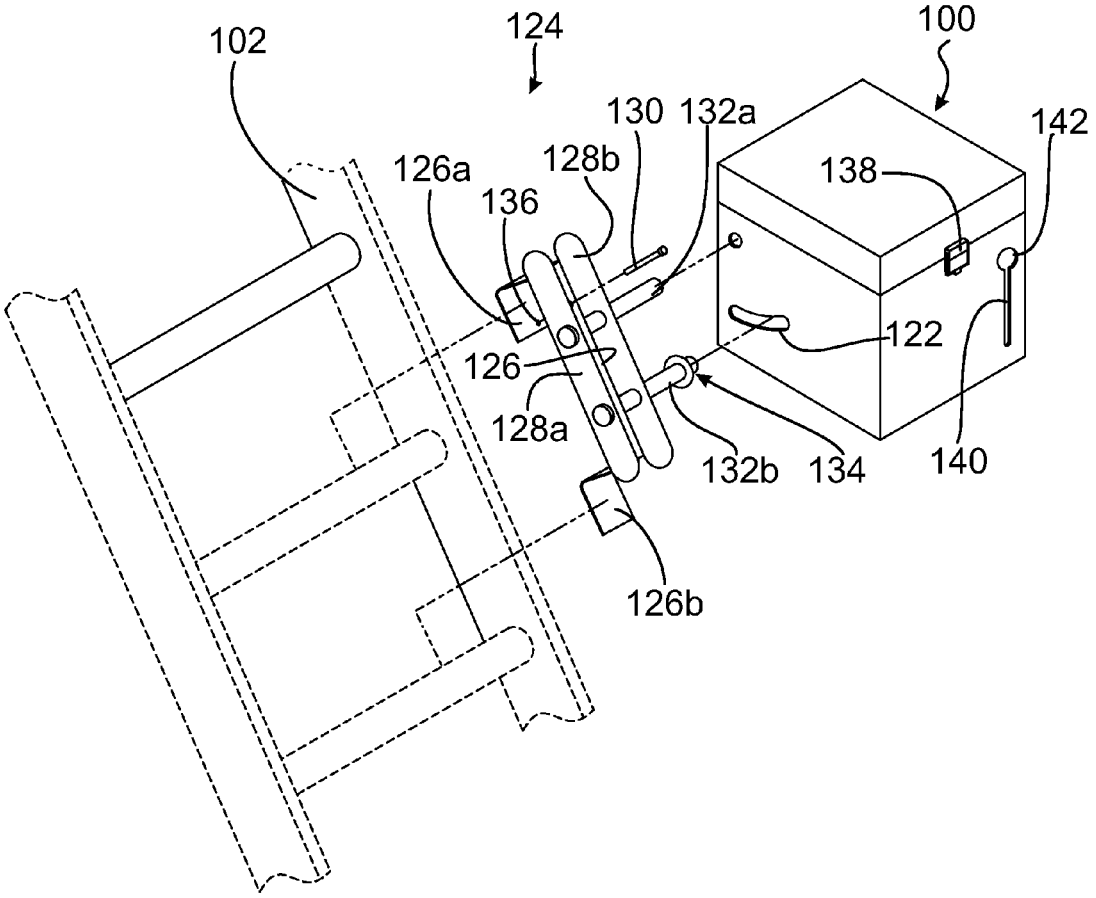
FIG. 2 is an exploded perspective, schematic view of the paint can retaining box and support system of FIG. 1 also shown attached to a ladder.

Referring now also to FIG. 2, there is shown an exploded perspective, schematic view of the paint can retaining box 100 and support system 124 of FIG. 1 also shown attached to a ladder 102.

Support system 124 consists of a thin flat strip, typically formed from metal such as aluminum, having upper rung engaging hook 126*a* and lower rung engaging hook 126*b* formed at proximal and distal ends thereof, respectively. Rung engaging hooks 126*a*, 126*b* may be sized and configured to accommodate a range of ladder rung sizes and shapes.

Upstanding sides 128*a*, 128*b* are attached to strip 126 and support upper axle 132*a* and lower axle 132*b*, both of which extend outwardly from and perpendicularly to sides 128*a* and 128*b*.

Lower axle 132*b* has a bearing and means for attaching disposed at a distal end, not specifically identified, thereof. Bearing and means for attaching 134 typically is made from a hard polymer such a Nylon® and has a shoulder having an outside diameter that is accepted in curvilinear slot 122. The means for attaching extends beyond the wall surrounding curvilinear slot 122 and, in cooperation with a washer, not shown, secures the distal end of lower axle within paint can retaining box 100. It will be recognized by those of skill in the art that numerous arrangements are known that may function satisfactorily for retaining lower axle 132*b* within slot 122 and allowing lower axle 132*b* to slide along slot 122. Consequently, the invention is not considered limited to the apparatus chosen for purposes of disclosure. Rather, the invention is intended to include any and all suitable mechanisms and systems for providing the described function.

A hole 136 in strip 126 is sized and configured to selectively receive and retain a pin 130 therein. Multiple holes 136 may be provided to accommodate various interring spacing on different ladders.

Figure 3:
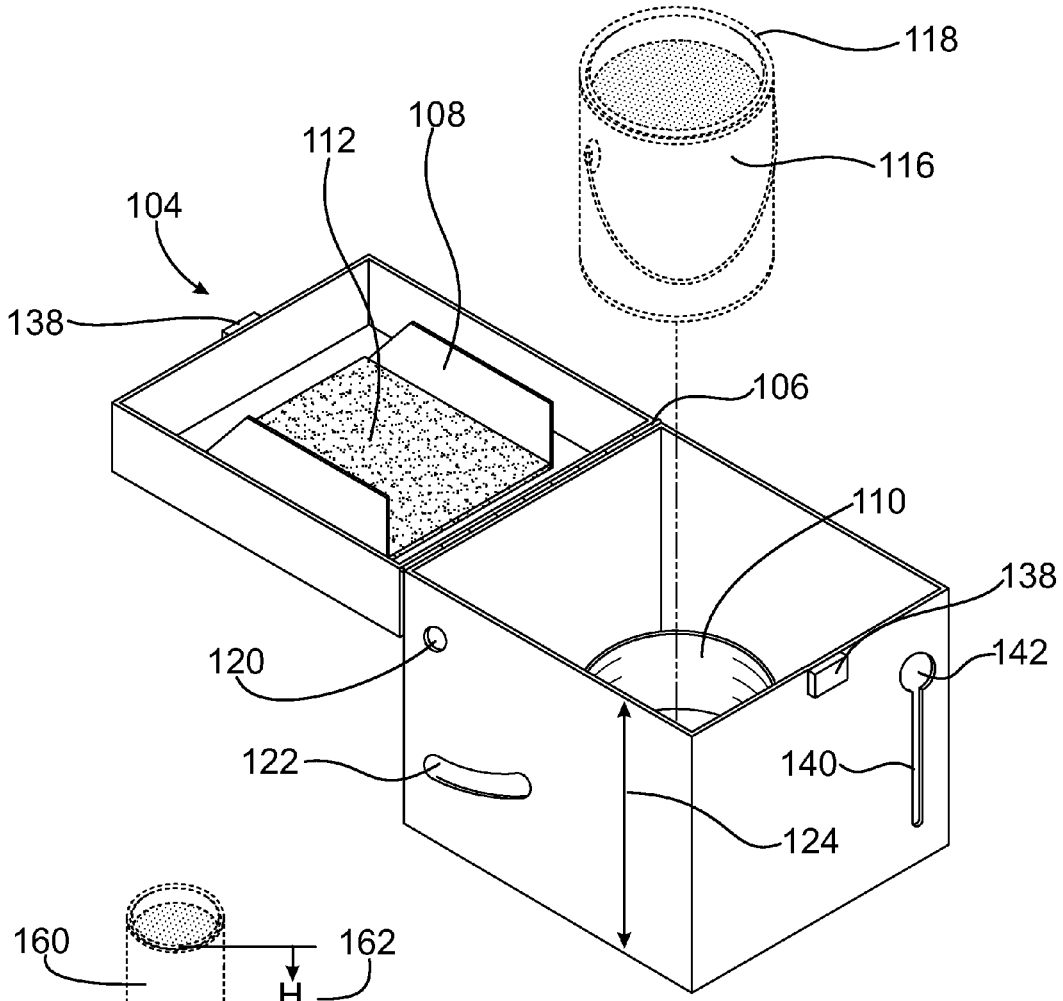
FIG. 3 is a top, perspective, schematic view of the paint can retaining box FIG. 1 with its cover open showing internal details of the box and cover.

Referring now also to FIG. 3, there is shown a top, perspective, schematic view of the paint can retaining box 100 of FIG. 1 with its cover 104 open showing internal details of the box 100 and cover 104.

Paint can retaining box 100 is a substantially rectangular box having a cover 104 attached to box 100 by a hinge 106. A can aligning structure 108 is affixed to an inside surface of cover 104. A gasket material such a neoprene 112 is affixed to can aligning structure 108.

A paint can securing structure 110 is affixed to a bottom, interior surface, not specifically identified, of box 100. Paint can securing structure 110 is typically cylindrical and has an inside diameter, not specifically identified, chosen to accept a standard one gallon container of paint or other similar material. As used herein, the term "paint" is used to refer to any liquid that might be stored in a container and used by a painter or other tradesman when working from a ladder, especially an extension ladder. It will be recognized that the diameter of paint can securing structure 110 may be sized to accommodate any other size container that may be used outside the United States to contain paint.

Paint can retaining box 100 has a height 124 chosen so that a standard one gallon can of paint is tightly sealed by compression of gasket 112 against the rim 118 of the paint can 116. The material from which gasket 112 is formed may be neoprene or similar material that will compress to form a tight seal, not absorb paint, and which may readily be cleaned after use. The invention is not intended to be limited by the neoprene material chosen for purposes of disclosure. Rather, the invention is intended to cover any and all suitable alternate materials. The Paint can 116 forms no part of the invention and is included merely to illustrate the functioning of paint can retaining box 100.

A hole 120 and a curvilinear slot 122 are provided in a side of paint can retaining box to facilitate attachment of paint can retaining box 100 to its support structure 124, best seen in FIG. 2.

Figure 4:
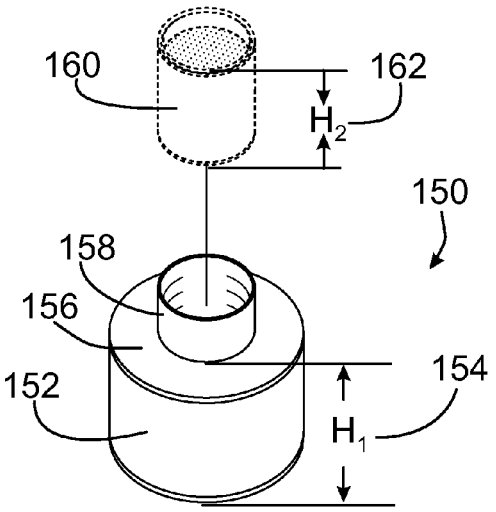
FIG. 4 is a top, perspective, schematic view of an adapter for use with a different size paint can.

Referring now also to FIG. 4, there is shown a top, perspective, schematic view of an adapter for use with a different size paint can in the paint can retaining box 100, generally at reference number 150. Adapter 150 has a cylindrical bottom portion 152 having an outside diameter, not specifically identified, that allows a paint can 160 smaller than the standard one gallon or other standard size paint container for which paint can retaining box 100 is sized and configured to be used therein. Paint can 160 forms no part of the invention and is shown to illustrate the operation of adapter 150.

Adapter 150 has a solid top 156 having a paint can retaining structure 158 centrally mounted thereupon. Paint can retaining structure 158 is sized and configured to hold paint can 160. Adapter 150 has a height measured from its base, not specifically identified to the top of solid top 156 $H_1$ 154.

Paint can 160 has a height $H_2$ 162. The combined height H1 154 and H2 162 is must be approximately equal to the height of a standard one gallon paint can 116 so that functionality of the sealing mechanism of the novel paint can retaining box 100 is preserved for a smaller paint can 160.

Typically, smaller paint can 160 could be a one quart paint can. However, it will be recognized that other paint can sizes known to those of skill in the art may be accommodated in paint can retaining box 100 by merely changing the dimensions of adapter 150 to be compatible with the desired paint can size. Consequently, the invention is not considered limited to a single size of smaller paint can. Rather the invention is intended to include any and all alternate smaller paint can sizes by modifying dimensions of adapter 150.

Figure 5:
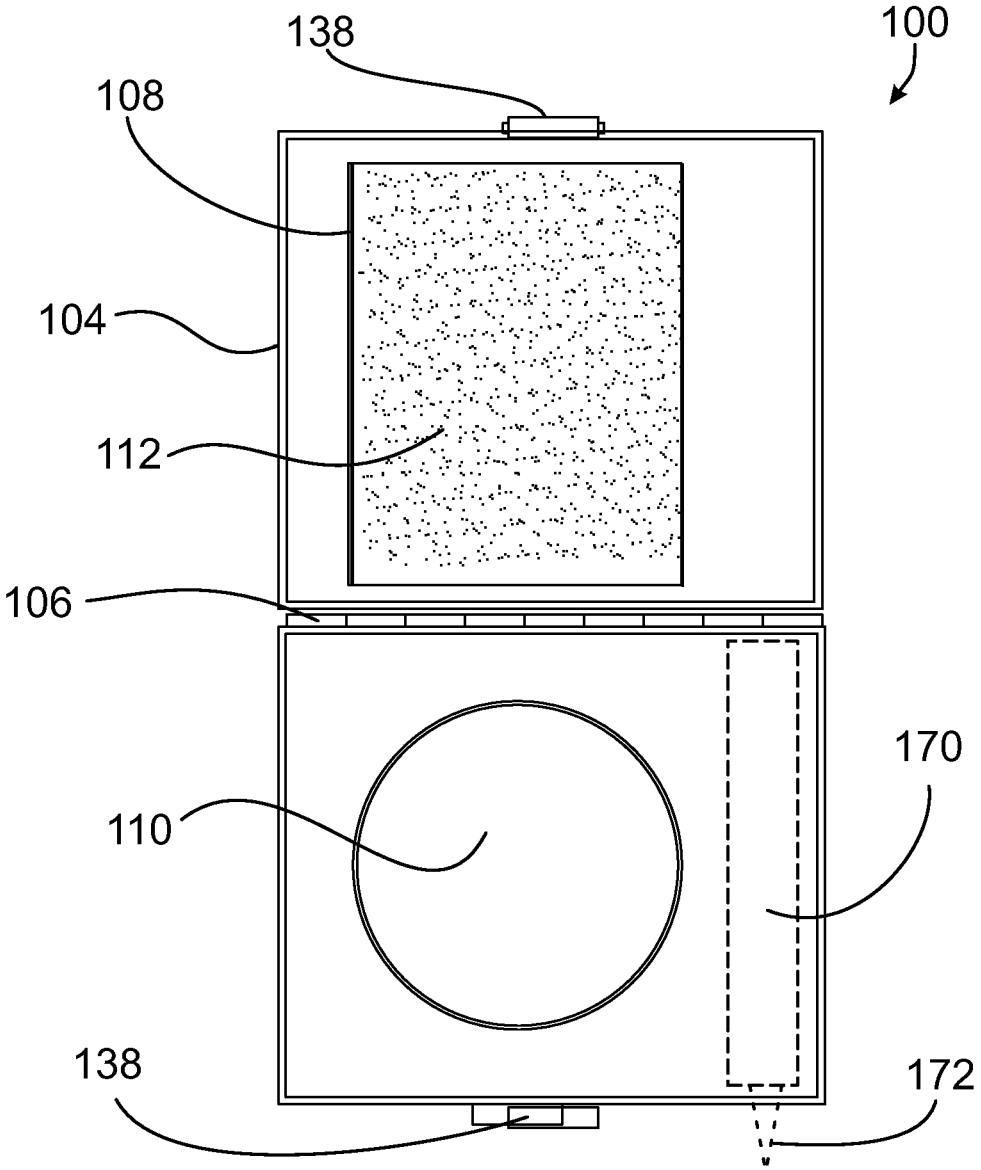
FIG. 5 is a top plan, schematic view of the of the paint can retaining box FIG. 1 with its cover open and showing optional caulk tube storage.

Referring now also to FIG. 5, there is shown a top plan, schematic view of paint can retaining box 100 with an optional tube of caulking or the like 170 disposed within. Caulking tube 170 has a nozzle 172 protruding from an end thereof, the caulk tube and nozzle 172 form no part of the invention. Enlarged opening 142 for keyhole shaped slot 140 typically has a diameter that accommodates insertion of a tube of caulk 170 into paint can retaining box 100 with nozzle 172 pointing outward. Once inserted through enlarged hole 142, the nozzle 172 of caulk tube may fall downward through keyhole-shaped slot 140 thereby retaining caulk tube 170 within box 100. Several tubes of caulk represented by caulk tube 170 may be stacked one upon another.

To remove a tube of caulk 170, its nozzle 172 is lifted upward until its body may be pulled outward through enlarged hole 142.

It will be recognized that while box 100 is disclosed for mounting on the right hand side of a ladder, a mirror image of box 100 may be provided for mounting on the left had side of a ladder to accommodate left-handed painters. A universal box having a second curvilinear slot, not shown as well as a second hole 120 and making the mounting apparatus 124 reversible, a single box 100 might be configured for either right-hand or left-hand use. Consequently, the invention is intended to include right-mad mounting boxes, left-hand mounting boxes, and reversible boxes.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A paint can retaining and sealing apparatus for use on a ladder, comprising:

a) a rectangular box having a closed bottom, four mutually orthogonal sides depending upward from said closed bottom, each of said four mutually orthogonal sides having an upper edge;

b) a lid hingedly attached to said upper edge of one of said four mutually orthogonal sides, said selected one of said four mutually orthogonal sides defining a rear side, said lid being selectively moveable between an open position and a closed position, said lid having a paint can aligning structure attached to an inside surface thereof, said lid further comprising gasket material on at least a portion of said inside surface;

c) a latching mechanism having a first portion disposed on a side of said lid opposite a hinged side and a second portion disposed on an opposite one of said four mutually orthogonal side sides from that side to which said lid is hingedly attached;

d) a paint can securing structure affixed to an inside surface of said closed bottom; and e) an attachment apparatus attached to said paint retaining and sealing apparatus and adapted for selective attachment to a pair of rungs of a ladder, said attachment comprising an upper, fixed axle and a parallel lower movable axle both attached to said ladder-engaging portion of said attachment apparatus and to said rectangular box, whereby said rectangular box remains substantially horizontal as an angle of inclination of said ladder changes;

whereby when a can of paint having its lid removed therefrom is placed within said paint can retaining and sealing apparatus with a lower portion of said can of paint disposed in said paint can securing structure, when a cover is moved to said closed position, said gasket material on at least a portion of said inside surface of said cover effectively seals an open top of said can of paint.

2. The paint can retaining and sealing apparatus for use on a ladder as recited in claim 1, wherein dimension of said rectangular box and said lid are chosen to accommodate a predetermined, standard size can of paint.

3. The paint can retaining and sealing apparatus for use on a ladder as recited in claim 2, wherein said standard size can of paint comprises a one gallon can of paint.

4. The paint can retaining and sealing apparatus for use on a ladder as recited in claim 2, further comprising:

f) an adapter having a lower portion having a base diameter approximately the base diameter of a one gallon can of paint and a solid upper member;

g) a paint can securing structure affixed to an upper surface of said upper solid member sized to accept a paint can of a smaller size than a one gallon can of paint.

5. The paint can retaining and sealing apparatus for use on a ladder as recited in claim 4, wherein the combined height of said lower portion and of said paint can of a smaller size is approximately the height of a one gallon can of paint.

6. The paint can retaining and sealing apparatus for use on a ladder as recited in claim 1, wherein said attachment apparatus attached to said paint can securing structure and adapted for selective attachment to a pair of rungs of a ladder, further comprising:

i) an elongated flat strip having a rung-engaging hook, disposed at a proximal end and a distal end thereof;

ii) a pair of upstanding side supports attached to a surface of said elongated flat strip, said pair of upstanding side supports being parallel to a major axis of said elongated flat strip and orthogonal to a surface thereof;

iii) said upper axle supported in said pair of upstanding side supports proximate a proximal end of said elongated flat strip, said upper axle being orthogonal to both said elongated flat strip and said pair of upstanding side supports; and iv) said lower axle supported in said pair of upstanding side supports proximate a distal end of said elongated flat strip, said upper axle being orthogonal to both said elongated flat strip and said pair of upstanding side supports.

7. The paint can retaining and sealing apparatus for use on a ladder as recited in claim 6, wherein one of said four mutually orthogonal sides adjacent said side supporting said hinge, further comprising:

v) a circular hole sizes and configured to accept and retain said upper axle therein;

vi) an elongated arcuate opening having a width to accept said lower axle therein; and vii) means for securing disposed at a distal end of said lower axle and inside said paint can retaining and securing apparatus;

whereby said paint can retaining and securing apparatus may rotate on said upper axle and assume angular orientations as said lower axle is positioned along said elongated arcuate opening.

8. The paint can retaining and sealing apparatus for use on a ladder as recited in claim 7, further comprising:

viii) a retaining pin selectively insertable in a hole in said elongated flat strip and configured to retain at least one of said rung-engaging hooks, disposed at a proximal end and a distal end of said elongated flat strip surrounding a ladder rung.

9. The paint can retaining and sealing apparatus for use on a ladder as recited in claim 1, wherein dimension of said rectangular box and said lid are chosen to accommodate a predetermined, standard size can of paint and additionally, at least one tube of caulk.

10. The paint can retaining and sealing apparatus for use on a ladder as recited in claim 9, wherein said front most of said four mutually orthogonal sides has a keyhole-shape slot having a major axis vertically aligned, said keyhole-shape slot having a circular opening at its uppermost terminus and an elongated, narrow slot depending downwardly therefrom.

11. The paint can retaining and sealing apparatus for use on a ladder as recited in claim 10, wherein said circular opening is sized to allow a maximum diameter of a tube of caulk to pass therethrough and wherein a width of said elongated narrow slot is sized to allow a nozzle of the tube of caulk to pass therealong.

* * * * *